US006836061B2

(12) United States Patent
Kim

(10) Patent No.: US 6,836,061 B2
(45) Date of Patent: Dec. 28, 2004

(54) SHADOW MASK FOR COLOR CATHODE RAY TUBE HAVING A SPECIFIC HOLE STRUCTURE

(75) Inventor: Sun-Hun Kim, Busan (KR)

(73) Assignee: LG. Philips Displays Korea Co., Ltd., Kyeongsangbuk-do (KR)

( * ) Notice: Subject to any disclaimer, the term of this patent is extended or adjusted under 35 U.S.C. 154(b) by 0 days.

(21) Appl. No.: 10/298,069

(22) Filed: Nov. 18, 2002

(65) Prior Publication Data

US 2003/0222561 A1 Dec. 4, 2003

(30) Foreign Application Priority Data

May 31, 2002 (KR) ..... 2002-30812

(51) Int. Cl.[7] ..... H01J 29/07
(52) U.S. Cl. ..... 313/402; 313/403
(58) Field of Search ..... 313/402, 403, 313/404, 405, 406, 407, 408; 445/47

(56) References Cited

U.S. PATENT DOCUMENTS 5,635,320 A * 6/1997 Ohtake et al. ..... 430/23
5,730,887 A * 3/1998 Simpson et al. ..... 216/12
6,597,092 B1 * 7/2003 Furusawa et al. ..... 313/402

FOREIGN PATENT DOCUMENTS

JP 04-010335 A 1/1992
JP 05-283016 A 10/1993
JP 07192644 A * 7/1995 ..... H01J/29/07

* cited by examiner

*Primary Examiner*—Nimeshkumar D. Patel
*Assistant Examiner*—Karabi Guharay
(74) *Attorney, Agent, or Firm*—Birch, Stewart, Kolasch & Birch, LLP

(57) ABSTRACT

A shadow mask for a color cathode-ray tube including a first portion on which a plurality of electron beam through holes are formed; and a second portion on which no electron beam through holes are formed, the second portion surrounding the first surface portion, wherein each of the plurality of electron beam through holes includes an electron beam exit hole, each of the electron beam exit holes of electron beam through holes formed at a periphery of the fist portion near the second portion having a first length Dh in a direction facing away from the center of the shadow mask that is greater than a second length Dv perpendicular to the direction facing away from the center of the shadow mask. Therefore, a vibration generated on the shadow mask is attenuated within an elastic range of shadow mask, and thereby the shadow mask is able to endure an external shock and a permanent distortion to the shadow mask can be prevented to ensure color purity of the color cathode-ray tube.

8 Claims, 4 Drawing Sheets

SHADOW MASK FOR COLOR CATHODE RAY TUBE HAVING A SPECIFIC HOLE STRUCTURE

CROSS-REFERENCE TO RELATED APPLICATION

The present application claims priority under 35 U.S.C. §119 to Korean Application No. 30812/2002, filed May 31, 2002, the entire disclosure of which is hereby incorporated by reference.

BACKGROUND OF THE INVENTION

1. Field of the Invention

The present invention relates in general to a shadow mask for a color cathode-ray tube and, more particularly, to a shadow mask having improved shock resistance by establishing a ratio of less than 1 between sizes of an electron beam through hole in an axial direction and in a direction vertical to the axial direction when an external shock is impressed on the cathode-ray tube, for example, during a drop intensity test. The electron beam through hole is formed by etching on the shadow mask which is included in the cathode-ray tube.

2. Description of the Background Art

Generally, a cathode-ray tube functions as a principal component in forming an image in an image display device, such as a television picture receiver or a computer monitor.

As shown in FIG. 1, a color cathode-ray tube is sealed by coupling a front glass, depicted as panel 10, to a rear glass, depicted as a funnel 20, thereby resulting in a vacuum within the color cathode-ray tube.

A fluorescent surface 40 of the color cathode-ray tube functions as a luminescent material and is located on an inner side surface of the panel 10. An electron beam 60, which illuminates the fluorescent surface 40, is generated by an electron gun 130. A shadow mask 70 sorts the electron beam 60 generated by the electron gun 130 so that the electron beam 60 can hit a predetermined part of the fluorescent surface 40. A frame 30 fixes and supports the shadow mask 70. A spring 80 and a stud pin 120 couples the frame 30 to the panel 10. An inner shield 90 is coupled to a side surface of the frame 30 opposite to a side surface of the frame 30 facing the panel 10, so that the cathode-ray tube is little affected by outer terrestrial magnetism during operation.

The electron gun 130 is mounted on an inner side surface of a neck portion 140 of the funnel 20. A deflection yoke 50 deflects the electron beam 60 generated by the electron gun 130 to a predetermined direction. A convergence and purity magnet (CPM) 100 controls more precisely the direction of the electron beam 60 deflected by the deflection yoke 50. Both the deflection yoke 50 and the CPM 100 are positioned on an outer side surface of the neck portion 140.

A reinforcing band 110 is mounted on an outer circumferential portion of the color cathode-ray tube that couples the panel 10 to the funnel 20, so that the panel 10 and the funnel 20 do not come apart as a result of atmospheric pressure on or an external disturbance to the color cathode-ray tube.

When the electron beam 60 generated by the electron gun 130 hits the fluorescent surface 40 by a positive voltage applied to the cathode-ray tube, the electron beam 60 is deflected to, for example, upper, lower, left, and right directions by the deflection yoke 50 before the electron beam 60 reaches the florescent surface 40.

The CPM 100 may include magnets of 2, 4, or 6 poles to correct successive tracks of the electron beam 60, so that the electron beam 60 can be more precisely directed on the predetermined fluorescent surface 40 to thereby prevent color purity defects.

The shadow mask 70 is formed in the shape of a dome, and a predetermined gap is maintained between the shadow mask 70 and the inside of the panel 10. As shown in FIG. 2, the shadow mask 70 includes an effective surface portion 71 on which a plurality of electron beam through holes 74 of dot shape are formed. A peripheral portion 72 surrounds the effective surface portion 71 and does not have many electron beam through holes 74. A mask skirt portion 73 is folded vertically from the peripheral portion 72 on the edge part of the peripheral portion 72. The shadow mask 70 has a thickness of about 0.1~0.3 mm. As shown in FIG. 2, the shadow mask 70, furthermore, has a longer length and a shorter depth.

In the conventional color cathode-ray tube, the electron beam 60 is generated by the electron gun 130, and the electron beam 60 is deflected to the upper, lower, left, and right directions by the deflection yoke 50 before the electron beam 60 reaches the shadow mask 70 and the fluorescent surface 40. Subsequently, the electron beam 60 passes through the shadow mask 70, which sorts the electron beam 60 by a plurality of through holes, and hits the predetermined fluorescent surface 40, thereby forming an image on the fluorescent surface 40.

As shown in FIGS. 3 and 4, the electron beam through hole 74 includes a circular-shaped electron beam incidence hole 74*a*, formed by etching, facing the inner surface of the funnel 20, and a circular-shaped electron beam exit hole 74*b* facing the inner surface of the panel 10.

Also, the angle of the electron beam 60 incident on the shadow mask 70 is changed by the specific position on the shadow mask 70 at which the electron beam 60 is incident; therefore, the width of the electron beam exit hole 74*b* is gradually increased as the beam exit hole 74*b* approaches the effective surface portion 71 on the shadow mask 70 in order to prevent the electron beam 60 from being scattered.

Although the quality of the color cathode-ray tube can be affected by a number of factors, the color purity of the realized image is the most important factor. The color purity is largely affected by a distortion of the shadow mask 70, which is mainly caused by an external shock. Dropping the color cathode-ray tube, for example, can cause a large shock to the color cathode-ray tube.

Also, when the panel 10, which is relatively heavy compared to other components of the color cathode-ray tube, is dropped to the ground, the shadow mask 70 may suffer severe distortion.

The above distortion is actually caused by the structural characteristics of the shadow mask 70, and this will be described in more detail as follows.

As described above, the shadow mask 70 includes the electron beam through holes 74 of predetermined shape, and the sizes of the electron beam through holes 74 gradually increase as the through holes 74 approach the peripheral parts of the shadow mask 70 in order to prevent the electron beam 60 from being scattered.

As a result, the cross sectional area and volume of the shadow mask 70 gradually decrease near the peripheral parts according to the above changes.

Consequently, in the event that the cathode-ray tube is dropped, the intensity of the shock resulting therefrom on the shadow mask 70 decreases in accordance with the decrease of the cross sectional area on the peripheral parts, and the weight also decreases in accordance with the decrease in volume.

The above structural property causes vibrations in an upper and lower direction on the shadow mask 70, when the side of the color cathode-ray tube on which the panel 10 is formed is dropped.

That is, in the event of an external shock to the cathode-ray tube, the central part of the shadow mask 70, which is exposed to a greater shock and has a greater weight compared to the peripheral parts, has a larger amplitude of vibration than that of the peripheral parts.

Therefore, a greater load impacts the central part of the shadow mask 70; and, accordingly, a distortion is generated having a greater intensity on a boundary of the central part and having a weaker intensity on the peripheral part.

Actually, the shadow mask 70 inside the cathode-ray tube becomes more sensitive as the size of the cathode-ray tube increases. In the event of a shock of a similar intensity, the shadow mask of a larger cathode-ray tube is more likely to suffer permanent damage as a result of a sudden distortion.

In the conventional cathode-ray tube, a length of the electron beam exit hole 74*b* in a direction facing away from the center of the shadow mask 70 is denoted by Dh, and a length of the electron beam exit hole 74*b* in a direction perpendicular to the direction facing away from the shadow mask 70 is denoted by Dv. As shown in FIG. 2, the electron beam through hole 74 satisfies the following equation near the peripheral parts of the shadow mask 70:

$$Dv/Dh \approx 1.$$

The diameter of the electron beam through hole 74 on the peripheral parts of the shadow mask 70 is larger than the diameter of the electron beam through hole 74 on the central part of the shadow mask 70 in order to prevent the electron beam 60 passing therethrough from being scattered. Therefore, the electron beam through hole 74 functions as a color-sorting electrode.

However, in the above structure, the structural intensity of the shadow mask is limited by problems caused by the dropping intensity test to which color cathode-ray tubes should, in general, be subjected, and a howling phenomenon may occur.

SUMMARY OF THE INVENTION

Therefore, an object of the present invention is to provide a shadow mask for a color cathode-ray tube which is able to improve shock resistance intensity by forming a ratio between sizes of an electron beam through hole in axial direction and in a direction vertically to the axial direction to be less than 1.

To achieve the object of the present invention, as embodied and broadly described herein, there is provided a shadow mask for a color cathode-ray tube including a first portion on which a plurality of electron beam through holes are formed; and a second portion on which no electron beam through holes are formed, the second portion surrounding the first surface portion, wherein each of the plurality of electron beam through holes includes an electron beam exit hole, each of the electron beam exit holes of electron beam through holes formed at a periphery of the first portion near the second portion having a first length Dh in a direction facing away from the center of the shadow mask that is greater than a second length Dv perpendicular to the direction facing away from the center of the shadow mask.

Also, in order to achieve the object of the present invention, there is provided a shadow mask for a color cathode-ray tube including a first portion on which a plurality of electron beam through holes are formed; and a second portion on which no electron beam through holes are formed, the second portion surrounding the first surface portion, wherein each of the plurality of electron beam through holes includes an electron beam exit hole, each of the electron beam exit holes of electron beam through holes formed at a periphery of the first portion near the second portion being formed in an oval shape with a maximum length Dh in a direction facing away from the center of the shadow mask and a minimum length Dv perpendicular to the direction facing away from the center of the shadow mask.

The foregoing and other objects, features, aspects and advantages of the present invention will become more apparent from the following detailed description of the present invention when taken in conjunction with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Reference will now be made in detail to the preferred embodiments of the present invention, examples of which are illustrated in the accompanying drawings.

Hereinafter, a shadow mask for a color cathode-ray tube according to the present invention will be described with reference to the accompanying figures in more detail.

In the conventional color cathode-ray tube including the shadow mask 70, an external shock is transmitted to the spring 80 first through the stud pin 120 on a panel, and after that, transmitted to the shadow mask 70 after passing through the frame 30.

The external shock which is finally transmitted to the shadow mask 70 causes a vibration and a distortion of the shadow mask 70.

Therefore, in order to prevent the shadow mask 70 from being distorted by the shock, the shock should be blocked or absorbed or the intensity of the shock on the peripheral portion of the shadow mask 70 should be increased.

In more detail, the distortion of the shadow mask 70 can be prevented by constructing the color cathode-ray tube to have a structure which can absorb the shock, or by including an additional member which absorbs the shock.

Also, the distortion of the shadow mask 70 can be prevented by changing the structural property of the shadow mask 70 to increase the intensity of the shock on the peripheral portion so that the shadow mask 70 is able to endure the external shock.

Figure 1:
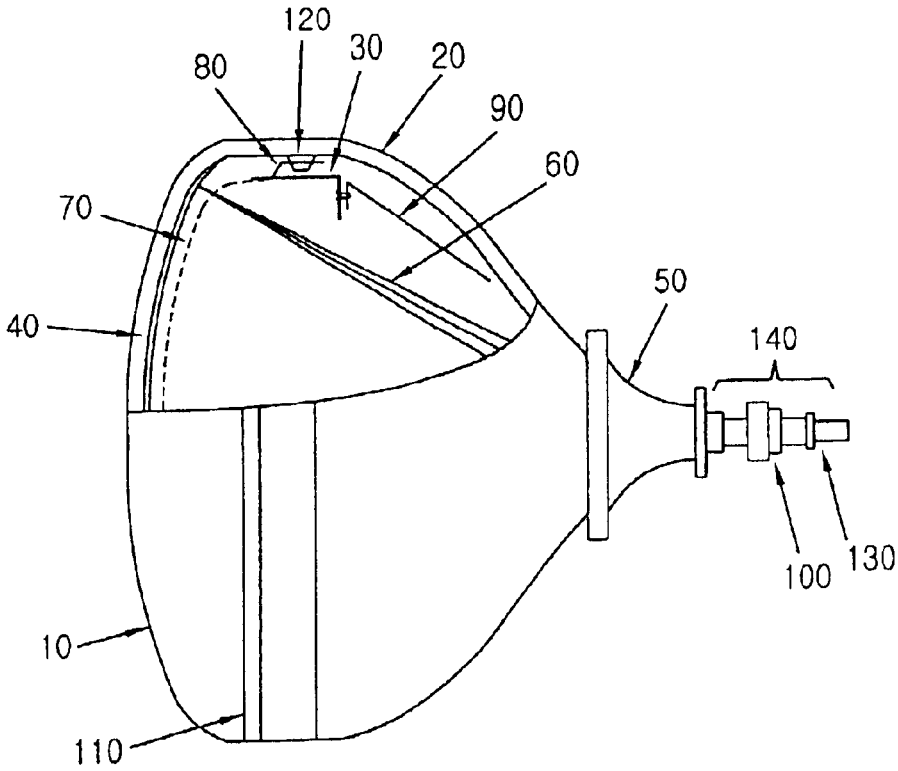
FIG. 1 CONVENTIONAL ART
FIG. 1 is a partial cross-sectional view showing a structure of the conventional color cathode-ray tube.
Figure 2:
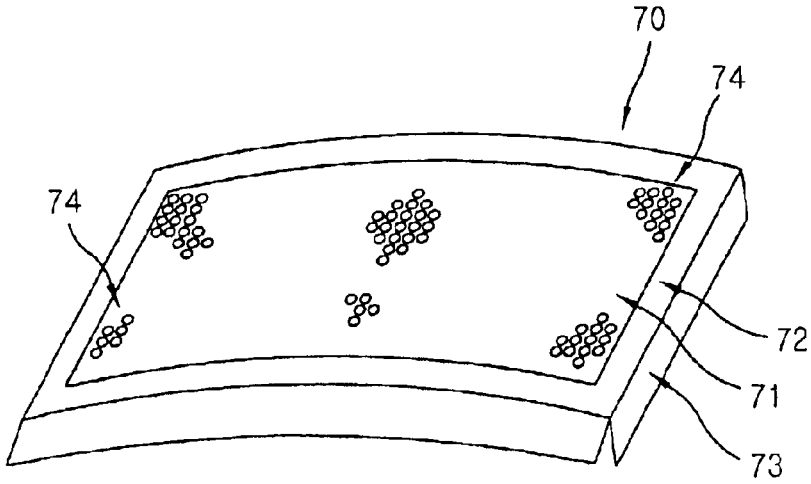
FIG. 2 CONVENTIONAL ART
FIG. 2 is a perspective view showing a general shadow mask in the conventional color cathode-ray tube.
Figure 3:
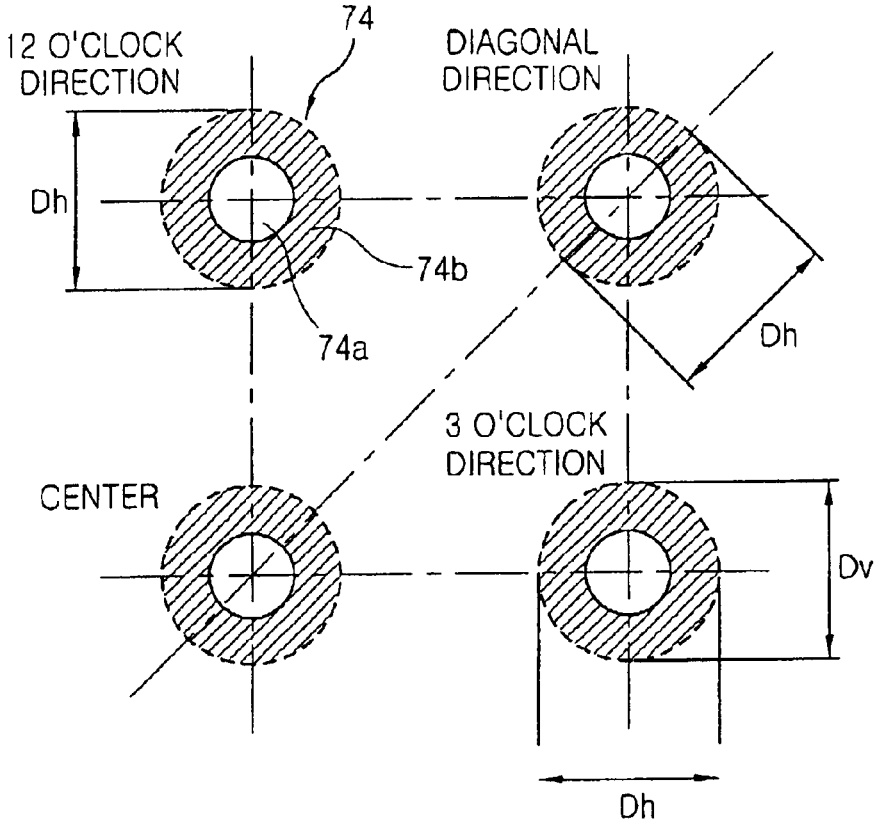
FIG. 3 CONVENTIONAL ART
FIG. 3 is a conceptual view showing a shape of an electron beam through hole formed on the conventional shadow mask.
Figure 4:
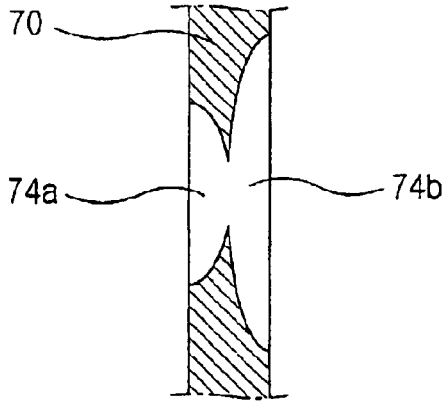
FIG. 4 is a cross-sectional view showing the electron beam through hole shown in FIG. 3.
Figure 5:
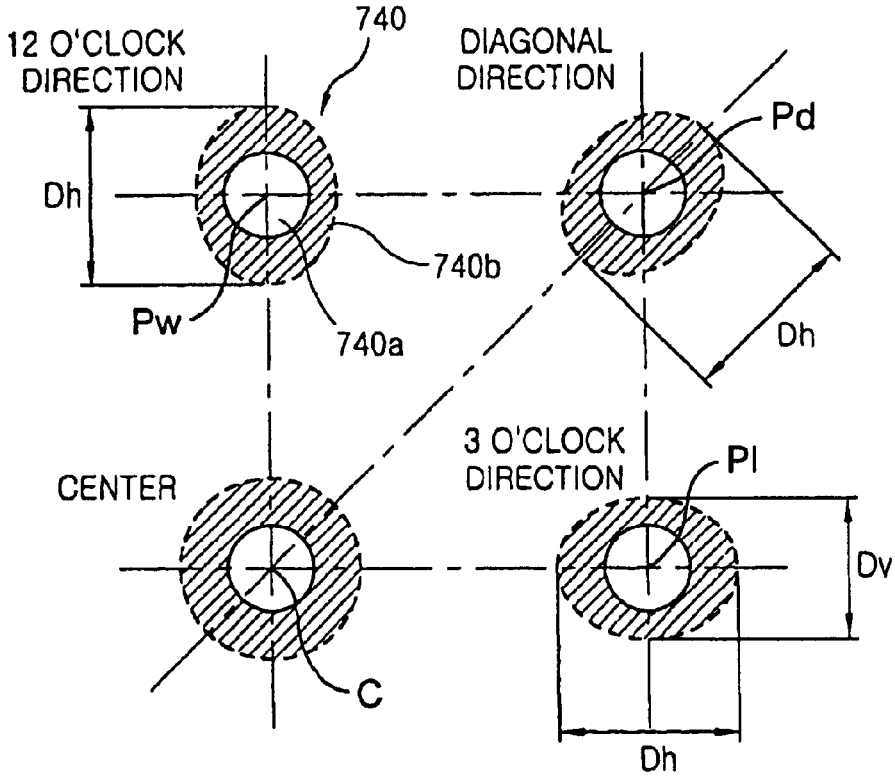
FIG. 5 is a conceptual view showing a shape of an electron beam through hole formed on a shadow mask for a color cathode-ray tube according to the present invention.
Figure 6:
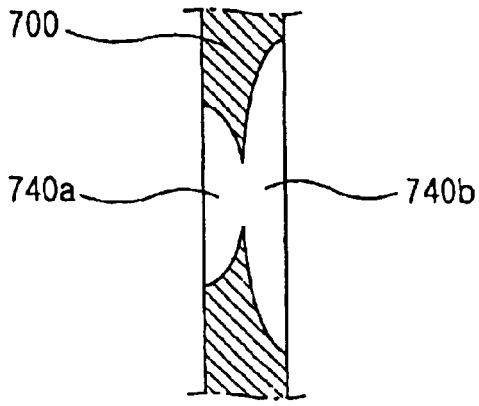
FIG. 6 is a cross-sectional view showing the electron beam through hole shown in FIG. 5 according to the present invention.

As shown in FIGS. 5 and 6, according to a shadow mask 700 of the present invention, the ratio of a length of an electron beam incidence hole 740*a* to a length of an electron beam exit hole 740*b* is less than 1 as the electron beam through holes approach the peripheral portion so as to endure the shock, and thereby the intensity of the shock on the peripheral portion is increased. Therefore, the vibration generated on the shadow mask 700 is attenuated within an elastic range of the shadow mask 700, and accordingly, the distortion of the shadow mask 700 can be prevented.

As shown in FIG. 6, the electron beam through hole 740 comprises an electron beam incidence hole 740*a* of circular shape formed by etching and facing the inner surface of the funnel 20, and an electron beam exit hole 740*b* of oval shape facing the inner surface of the panel 10.

That is, the electron beam exit hole 740*b* is formed in the shape of an oval. The length of each electron beam exit hole 740*b* reaches a maximum in the direction facing away from the center of the shadow mask 700, and reaches a minimum perpendicular to the direction facing away from the center of the shadow mask 700. The length of the electron beam exit hole 740*b* in the direction facing away from the center of the shadow mask 700 is denoted as Dh, while the length of the electron beam exit hole 740*b* perpendicular to the direction facing away from the center of the shadow mask 700 is denoted as Dv.

The ratio Dv/Dh of the electron beam exit hole 740*b* on a point 90% of the distance from the center towards the edge along the longer length of the shadow mask 700 is constructed to be within the range of 0.75~0.94. The ratio Dv/Dh of the electron beam exit hole 740*b* on a point 90% of the distance from the center towards the edge along the shorter length of the shadow mask 700 is constructed to be within the range of 0.75~0.98. The ratio Dv/Dh of the electron beam through hole 740 on a point 90% of the distance from the center towards the edge along the diagonal length of the shadow mask 700 is constructed to be within the range of 0.75~0.98.

FIG. 5 shows reference letter "C" defining a central point of the shadow mask; reference letter "Pl" defines a point 90% of the distance from the center to the edge along a length of the shadow mask; reference letter "Pw" defines a point 90% of the distance from the center to the edge along a width of the shadow mask and reference letter "Pd" defines a point 90% of the distance from the center to the edge along a diagonal length of the shadow mask.

The shock intensity property of the color cathode-ray tube is thereby improved and, at the same time, the vibration in the howling property can be satisfied by limiting the point at which the ratio Dv/Dh is measured along the longer length, the shorter length, and the diagonal length of the shadow mask 700.

The ratio Dv/Dh is set to be larger than 0.75, because it is the limitation value to which the ratio is limited by the fabrication process during etching of the mask increase of the shock. The ratio Dv/Dh is set to be less than 0.98, because the increase of the shock intensity on the peripheral portion is minimal when the ratio is greater than 0.98.

Figure 7:
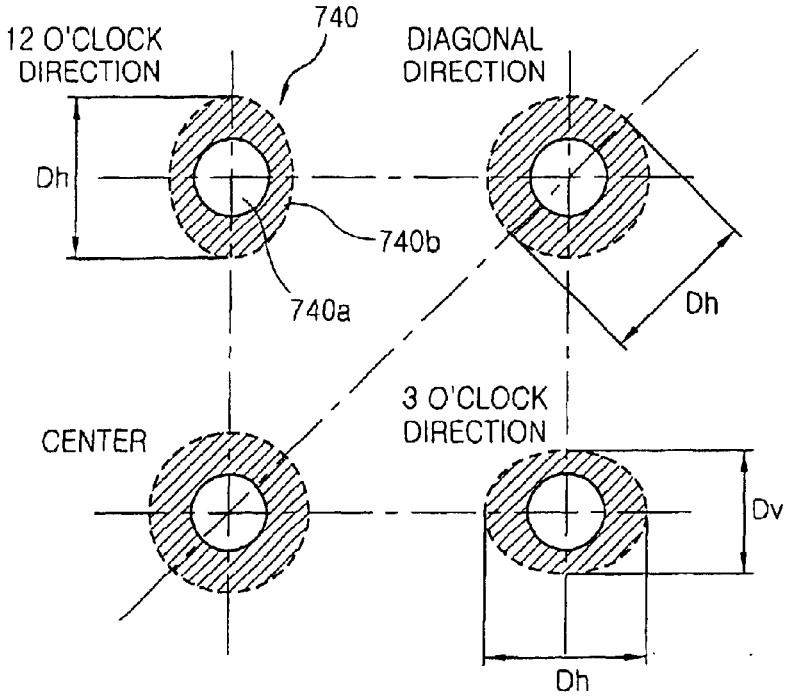
FIG. 7 is a conceptual view showing another embodiment of the electron beam through hole formed on the shadow mask for the color cathode-ray tube according to the present invention.

Also, on the end of the diagonal axis near the corner of the shadow mask 700, the color purity of the image decreases because the purity margin is reduced. To solve this problem, at least one electron beam exit hole is formed on the end of the diagonal axis to be roughly in the shape of a circle as shown in FIG. 7, thereby increasing the purity margin.

By such an improved shock resistance capability, a distortion in the shadow mask can be prevented. Accordingly, color purity can be ensured when the image is realized, and the volume and weight on the peripheral portion of the shadow mask are gradually decreased compared to those of the central part.

In order to demonstrate the present invention, a test was performed, the results of which are described below.

Generally, the dropping intensity is measured in Gs, wherein 1G is a value representing the intensity resulting from the acceleration due to gravity.

Figure 8:
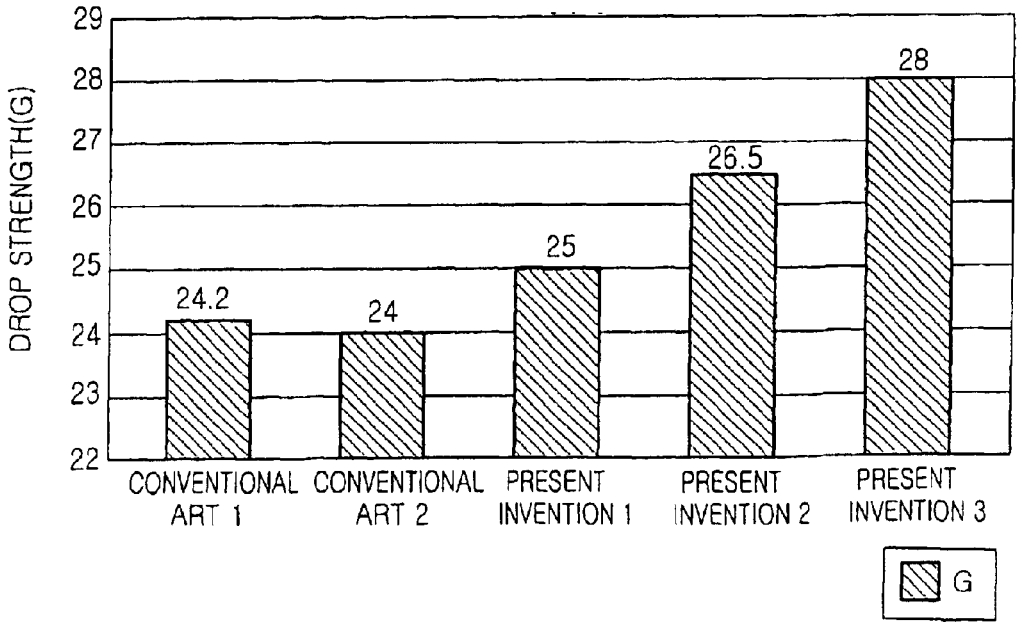
FIG. 8 is a graph showing a dropping intensity when the shadow mask for the color cathode-ray tube according to the present invention comparing to that of conventional art.

Table 1 and FIG. 8 show examples of dropping intensities, measured in Gs, that can be attained by the conventional art and the present invention. In Table 1, L denotes the longer length, S denotes the shorter width, and D denotes the diagonal length, respectively, along the shadow mask 700. Each of the Dv/Dh ratios represents a value on a point 90% of the distance toward the edge of the shadow mask 700. The maximum value of the dropping intensity that can be obtained according to the present invention is 28G. This intensity is improved by as much as a 17% over the intensity value of the conventional art. The minimum dropping intensity attained by the present invention is 25G. This value is larger than the maximum intensity attainable by the conventional art, which is 24.2G.

TABLE 1

| | Conventional art 1 | | | Conventional art 2 | | | Present invention 1 | | | Present invention 2 | | | Present invention 3 | | |
|---|---|---|---|---|---|---|---|---|---|---|---|---|---|---|---|
| | L | S | D | L | S | D | L | S | D | L | S | D | L | S | D |
| Dv/Dh | 0.95 | 1.00 | 0.98 | 1.00 | 1.00 | 1.00 | 0.94 | 0.98 | 0.98 | 0.83 | 0.88 | 0.77 | 0.75 | 0.75 | 0.75 |
| Dropping intensity | | 24.2 | | | 24.0 | | | 25.0 | | | 26.5 | | | 28.0 | |

According to the shadow mask of the present invention, the ratio of lengths Dv/Dh of the electron beam through hole is made to be less than 1 as the electron beam through hole approaches the peripheral portion, thereby the intensity of an external shock on the peripheral portion on the shadow mask is improved. Therefore, a vibration generated on the shadow mask is attenuated within the elastic range of the shadow mask, and a permanent distortion can be prevented.

Also, according to the present invention, the dropping intensity which can not be reached by the conventional art can be exceeded; therefore, the shadow mask is able to endure an external shock, and permanent distortion of the shadow mask can be prevented. As a result, the color purity of the color cathode-ray tube can be maintained.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A shadow mask for a color cathode-ray tube, comprising:

a first portion on which a plurality of electron beam through holes are formed; and a second portion on which no electron beam through holes are formed, the second portion surrounding the first surface portion, wherein each of the plurality of electron beam through holes includes an electron beam incidence hole and an electron beam exit hole, each of the electron beam exit holes of electron beam through holes formed at a periphery of the first portion near the second portion having a first length Dh in a direction facing away from the center of the shadow mask that is greater than a second length Dv perpendicular to the direction facing away from the center of the shadow mask, and centers of the electron beam incidence holes beam aligned with centers of corresponding electron beam exit holes.

2. The shadow mask according to claim 1, wherein the ratio Dv/Dh of each electron beam exit hole on a point 90% of a distance from the center to an edge along a length of the shadow mask satisfies following equation:

$$0.75 \leqq Dv/Dh \leqq 0.94.$$

3. The shadow mask according to claim 1, wherein the ratio Dv/Dh of each electron beam exit hole on a point 90% of the distance from the center to an edge along a width of the shadow mask satisfies following equation:

$$0.75 \leqq Dv/Dh \leqq 0.98.$$

4. The shadow mask according to claim 1, wherein the ratio Dv/Dh of each electron beam exit hole on a point 90% of the distance from the center to an edge along a diagonal length of the shadow mask satisfies following equation:

$$0.75 \leqq Dv/Dh \leqq 0.98.$$

5. The shadow mask according to claim 1, wherein the first length Dh is the maximum length of each electron beam exit hole.

6. The shadow mask according to claim 1, wherein the second length Dv is the minimum length of each electron beam exit hole.

7. A shadow mask for a color cathode-ray tube, comprising:

a first portion on which a plurality of electron beam through holes are formed; and a second portion on which no electron beam through holes are formed, the second portion surrounding the first surface portion, wherein each of the plurality of electron beam through holes includes an electron beam incidence hole and an electron beam exit hole, each of the electron beam exit holes of electron beam through holes formed at a periphery of the first portion near the second portion being formed in an oval shape with a maximum length Dh in a direction facing away from the center of the shadow mask and a minimum length Dv perpendicular to the direction facing away from the center of the shadow mask, and centers of the electron beam incidence holes being aligned with centers of corresponding electron beam exit holes.

8. The shadow mask of claim 7, wherein at least one electron beam exit hole among a plurality of electron beam exit holes on a diagonal length from the center to the edge of the shadow mask is formed roughly in a circular shape.

* * * * *